219-121
3/1/88 XR 4,728,083 SR

United States Patent [19]
Ruediger

[11] Patent Number: 4,728,083
[45] Date of Patent: Mar. 1, 1988

[54] METHOD AND APPARATUS FOR SCRIBING GRAIN-ORIENTED SILICON STEEL STRIP

[75] Inventor: Richard L. Ruediger, Natrona Heights, Pa.

[73] Assignee: Allegheny Ludlum Corporation, Pittsburgh, Pa.

[21] Appl. No.: 809,647

[22] Filed: Dec. 16, 1985

[51] Int. Cl.[4] ..... C21B 3/00
[52] U.S. Cl. ..... 266/274; 219/121 L; 219/121 LE; 219/121 LY; 148/111; 148/112
[58] Field of Search ..... 148/110, 111, 112, 113; 266/274, 277; 219/121 L, 121 LE, 121 LF, 121 LP, 121 LM, 121 LH, 121 LJ, 121 LW, 121 LY

[56] References Cited

U.S. PATENT DOCUMENTS 4,500,771 2/1985 Miller ..... 219/121
4,535,218 8/1985 Krause et al. ..... 219/121 LH

FOREIGN PATENT DOCUMENTS 0140663 8/1985 European Pat. Off. .
2146567 10/1984 United Kingdom .

*Primary Examiner*—John P. Sheeman
*Attorney, Agent, or Firm*—Patrick J. Viccaro

[57] ABSTRACT

A method and apparatus are provided for scribing grain-oriented silicon steel to improve core losses and which can be used at typical strip line speeds. The method and apparatus provide for moving the strip and forming the strip about an axis parallel to the strip movement, rotating a body having scribing means mounted at or about the periphery and scribing the strip at selected spaced-apart intervals substantially transverse to the strip direction.

5 Claims, 4 Drawing Figures

METHOD AND APPARATUS FOR SCRIBING GRAIN-ORIENTED SILICON STEEL STRIP

BACKGROUND OF THE INVENTION

This invention relates to a method and apparatus for improving core loss values of grain-oriented silicon steel. More particularly, this invention relates to a method and apparatus for "scribing" a moving steel strip to reduce the domain wall spacing to reduce the core loss values.

Grain-oriented silicon steel in the form of strip is produced typically in cold-rolled form. Grain-oriented silicon steels, because of having low core loss, are used in electrical applications such as laminates for the manufacture of transformer cores. Improvement by way of reduction of core loss values in grain-oriented silicon steels is a function of the degree of grain orientation of the steel. It has been determined that core loss values may be reduced by decreasing the magnetic domain wall spacing of the steel strip. It is known to achieve this by scribing the strip in a direction transverse and substantially normal to the rolling direction. This may be achieved by mechanical scribing arrangements wherein a scribing roll is used or by nonmechanical or noncontact arrangements, such as the use of laser devices. Conventional mechanical scribing practices are not sufficiently rapid to be compatible with typical strip line speeds and, therefore, cannot produce the scribe lines at the selected intervals along the length of the strip. In addition, these practices are difficult to control from the standpoint of the magnitude and uniformity of scribing. Laser practices are also expensive and subject to high maintenance costs.

U.S. Pat. No. 4,500,771, issued Feb. 19, 1985, discloses an apparatus and method of scribing ferromagnetic strip material which includes curving the strip around an axis which is parallel to the direction which it is being translated by pairs of convex and concave rollers and then scribing the curved sheet by laser scribing.

EPO Application 140663A (corresponding to U.S. application Ser. No. 545,080, filed Oct. 24, 1983) discloses a platform rotatable about a central axis on which optical elements, such as mirrors, beam splitters, and/or focussing lenses may be mounted for directing a laser beam to treat a curved and moving electrical steel trip to reduce core loss. The steel strip is curved by pairs of convex and concave rollers.

It is, accordingly, a primary object of the present invention to provide a scribing technique that may be used with both contact and noncontact scribing means wherein the scribing at the required intervals may be achieved at typical silicon steel strip line speeds with control of the scribing operation being possible relative to strip line speeds so that the scribing operation may be controlled to produce scribe lines substantially normal to the strip rolling direction at selected intervals along the length of the strip.

It is also desirable to provide a temporary curvature to the strip during scribing without scratching or otherwise damaging the strip surface or crystal structure which could deteriorate watt losses.

This and other objects of the invention, as well as a more complete understanding thereof, may be obtained from the following description and drawings.

SUMMARY OF THE INVENTION

In accordance with the present invention, a method is provided which includes moving the strip, forming the moving strip about an axis parallel to the direction of strip movement, rotating a carriage body having scribing means mounted at or about the periphery thereof and movable therewith, providing the concave strip surface into scribing contact with the scribing means, regulating the relative speeds of the strip and rotation of the carriage body, and scribing the strip with selected spaced-apart scribe lines substantially transverse to the direction of strip movement.

An apparatus is also provided having a carriage body rotatable about an axis, means for rotating the body, means for scribing mounted on the body at or about the periphery, means for moving the strip, means for forming the strip into an arcuate shape about an axis parallel to the direction of strip movement, means for bringing the concave surface of the strip into scribing contact with the scribing means, and means for regulating the relative speeds of the strip and rotation of the body so as to produce selected spaced-apart scribe lines on the strip surface substantially transverse to the direction of strip movement.

DETAILED DESCRIPTION OF THE PREFERRED EMBODIMENTS

Broadly, the invention comprises providing a rotating carriage body having scribing means mounted at or about its periphery. The strip is moved in a direction generally tangential to the body periphery and before or as it passes the body, it is arcuately formed to bring the surface thereof to be scribed into contact with the scribing means mounted on the body periphery. The relative speed of strip movement and speed of body rotation are regulated to produce the desired scribe lines substantially transverse to the rolling direction of the strip along the strip surface at selected and uniform intervals.

Figure 1:
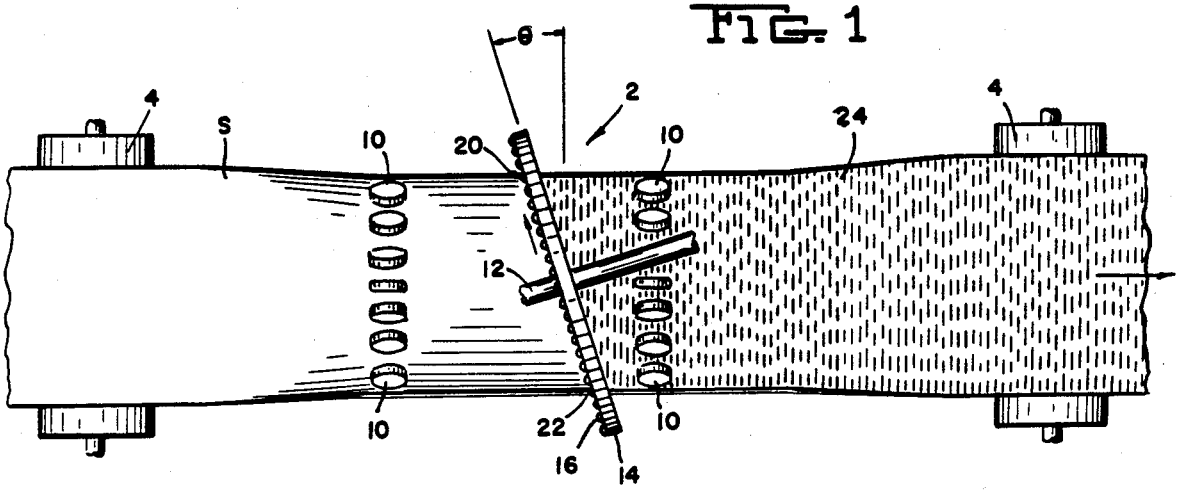
FIG. 1 is a schematic plan view of an embodiment of the apparatus of the present invention.
Figure 2:
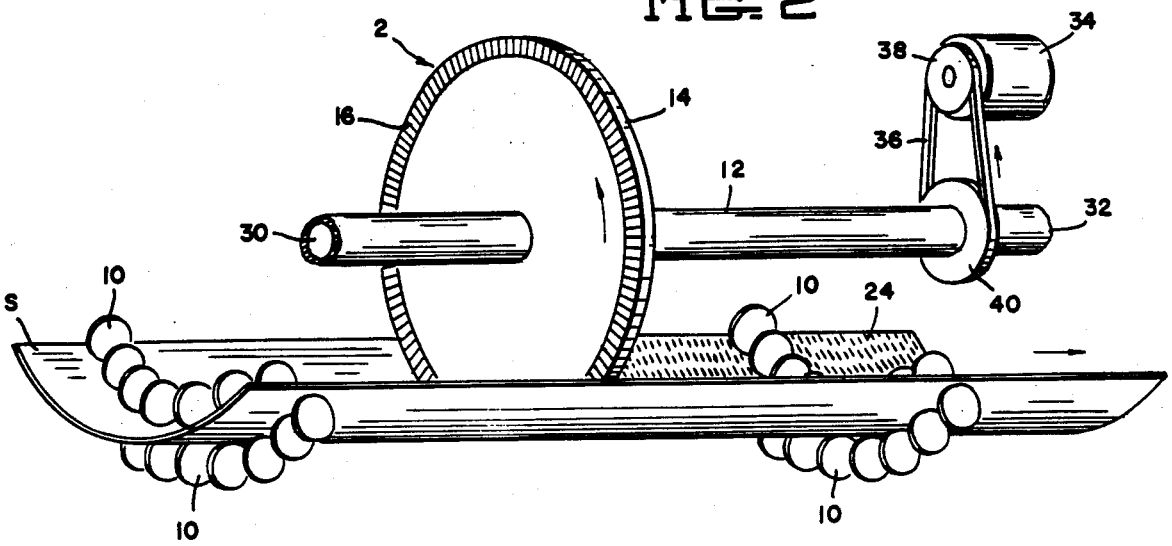
FIG. 2 is an elevation view of an embodiment of the apparatus of the present invention.

FIG. 1 is a schematic plan view generally showing part of scribing apparatus 2 for scribing strip S moving in the direction shown by the arrows by conventional roll means 4 and rollers 10 for temporarily forming the strip. The means for scribing 16 are mounted at or near the periphery of rotatable carriage body 14 for scribing the arcuate strip (as shown in FIG. 2) with scribe lines 24 as body 14 rotates.

Carriage body 14 may be any of various shapes, although a disc-shape or wheel is preferred. Body 14 must be rotatable about a central axis, such as about central shaft 12. In order to carry out the invention, the diameter of body 14 should be at least as great as and, preferably, greater than the width of strip S being scribed in order that the entire strip width can be scribed by a single scribing device without translating or otherwise moving the carriage body across the strip width during scribing.

The invention is adapted for use with both contacting and noncontacting scribing means 16, and the term "scribing contact" or similar expression includes both. Contacting-type scribing devices may include a mechanical stylus or serrating tool which could be mounted on the periphery of body 14 and brought into sliding contact with the strip surface to achieve the desired scribing by mechanical abrading or scratching of the strip surface. For noncontacting-type scribing devices, such as disclosed in United Kingdom Application No. GB 2146567A, published Apr. 24, 1985, the scribing means may be an electrode mounted on the periphery of body 14 and adapted to produce electrical arcs between the electrode and the steel strip to be scribed, which arcs produced scribe lines as the electrode traverses the strip by rotation of body 14. Other scribing means may also be suitable for use with the present invention. Scribing means 16 preferably includes a plurality of individual scribing devices mounted near the periphery of body 14, which devices produce a plurality of scribe lines substantially transverse to the direction of strip movement when brought into scribing contact with the moving strip. The scribing means 16 preferably are equi-spaced at or about the periphery to facilitate providing uniformly-spaced scribe lines 24.

Though shown in the Figures as broken lines 24, the scribe lines may be continuous or discontinuous. As used herein, scribe lines 24 may take any of various forms which depend upon the scribing devices used.

Figure 3:
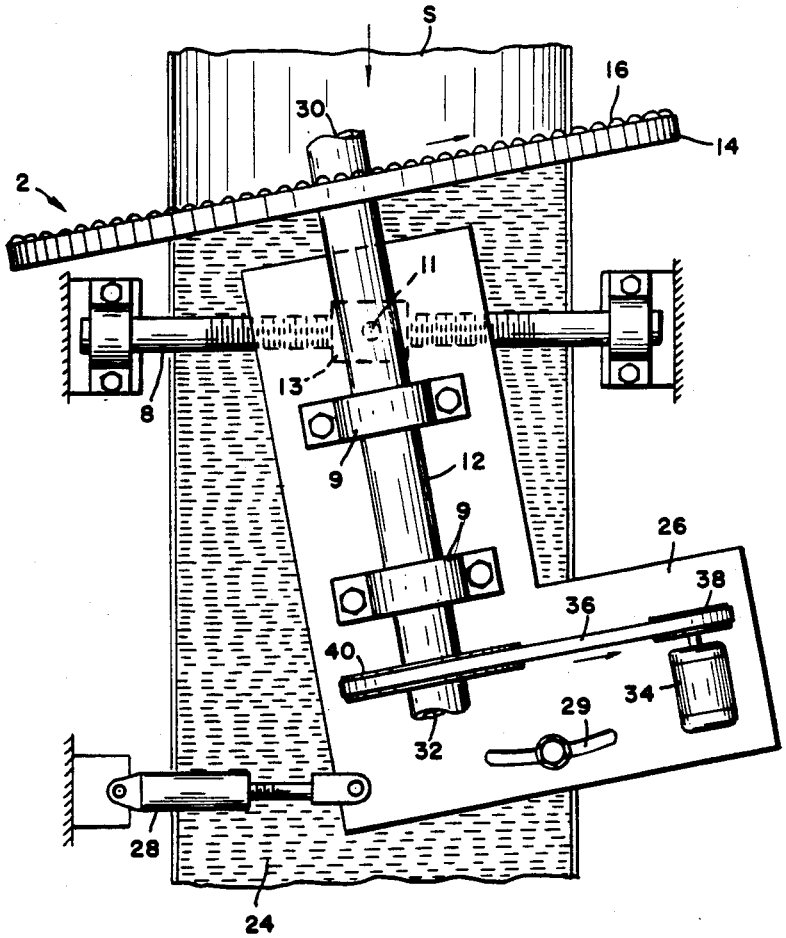
FIG. 3 is a partial detailed plan view of an embodiment of the apparatus of the present invention.

The means for rotating the carriage body may include drive means which may include motors, drive belts, pulleys and the like to rotate shaft 12 at one or both ends. As shown in FIGS. 2 and 3, a variable-speed drive motor 34 is drivingly connected to shaft 12 by means of a belt drive 36 connected to a pulley 38 of motor 34 and a pulley 40 which is mounted on shaft 12.

Shaft 12 may be hollow to provide for passage of electrical wiring or the like to the scribing means 16. Shaft 12 may also include a means for cooling the scribing apparatus 2 by provisions for inlet and outlet of a cooling medium to scribing means 16. The shaft may be cooled by a fluid, such a water, which may enter shaft 12 through inlet 30, flow through a longitudinal passage (not shown) and exit through outlet 32 or the like.

Means for forming the strip into an arcuate shape about an axis parallel to the direction of strip movement and for bringing the surface to be scribed into scribing contact with the scribing means may include a plurality of rollers 10 positioned on opposite sides of the strip to roll form the strip as it passes between the rollers to provide a strip pass line that substantially conforms to the rotatable periphery of body 14 (as shown in FIG. 2). The radius of arc curvature of the strip would essentially equal the distance of the periphery of the body 14 to the axis of rotation. Such forming means should minimize contact with the moving strip S so as to minimize slippage or burnishing of the strip surface. For example, use of a pair of solid crowned convex and concave rollers would result in differential surface speeds across each roll width due to different diameters across the roll width. Such differences in speeds could damage the surface of grain-oriented silicon steel. Rollers 10 may be driven rollers, but, preferably, are nondriven, freely rotatable rollers. The shape of rollers 10 should minimize strip contact and preferably make line contact only with the moving strip. Preferably, each roller 10 has a donut-shaped configuration, i.e., rounded cross section, so as to make only a line contact with the moving strip.

Figure 1A:
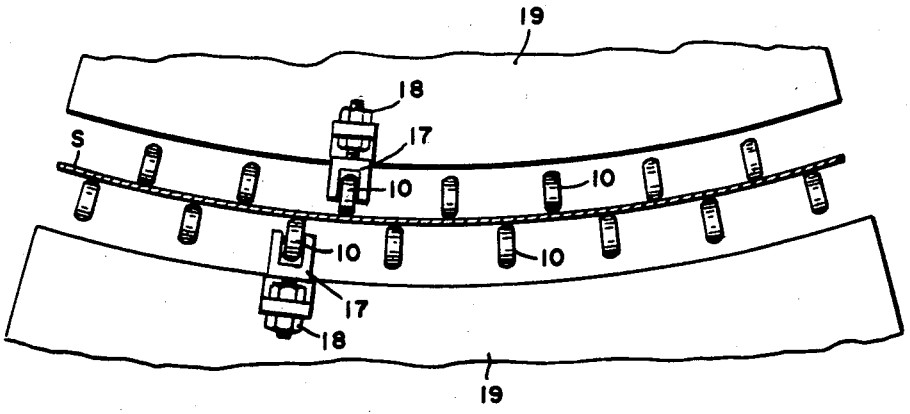
FIG. 1*a* is an elevation view of an embodiment of forming rollers of the present invention.

Preferably, some of rollers 10 are individually adjustable. Adjustable rollers facilitate the roll-forming operation that bends the strip to provide a pass line between rollers 10 that substantially conforms to the arc defined by the periphery of rotatable body 14. For example, as shown in the schematic elevation view of FIG. 1*a*, rollers 10 are individually supported and arranged on upper and lower roller mounting plates 19 by separate yokes 17 across the strip S width, which travels into or out of the page. Mounting plates 19 generally define the arcuate pass line shape and each has separate yokes 17 for rollers 10. Yokes 17 may be adjustable by any of various fastener assemblies. FIG. 1*a* shows a threaded screw and nut arrangement 18 which can accurately define and maintain the desired pass line for forming strip S.

Preferably, means for orienting the carriage body 14 is also provided as shown in the partial detailed plan view of FIG. 3. Body 14 may be tilted or oriented to form an angle relative to the strip surface to be scribed in relation to the speed of strip movement so that the scribing operation may be regulated relative to strip movement so that scribe lines are produced at selected intervals along the strip surface. The means for orienting body 14 may include a means for tilting shaft 12 to change the angle of disc-shaped body 14 relative to strip S as shown in FIGS. 1 and 3. Together with the relative speed of strip movement and rotating body 14, the scribing action of apparatus 2 may be regulated to produce scribe lines on the strip surface at selected and uniform intervals. As shown in the FIG. 3 the means may include a supporting plate 26 on which shaft 12 and means for rotating shaft 12 and carriage body 14 are supported. Pillow block bearing 9 may be used to attach shaft 12 to support plate 26. Shaft 12 may be tilted or oriented by incremental adjustments to plate 26 through the adjustments of mechanical screw 8 and linear actuator 28. Screw 8 may be threaded through a threaded bushing 13 attached to the bottom side of support plate 26. Bushing 13 can swivel about fastening means 11. By turning screw 8, the support plate 26 and carriage body 14 can be located at preselected locations across and adjacent strip S. Similarly, a linear actuator 28 or screw located at an opposite end of support plate 26 can move the other end of plate 26 at slot 29 and accordingly moves shaft 12. The combined effect is to tilt or orient shaft 12 and carriage body 14 at a selected angle relative to strip S.

The plane of rotation of the scribing means defined by the moving scribing means on rotating body 14 preferably forms an angle relative to the strip surface to be scribed. The angle $\theta$ may be measured between the plane of rotation and a plane perpendicular to the direction of strip movement, as shown in FIG. 1. The angle may range from 0° to 45° and preferably, from 5° to 15°.

The scribe lines formed by the present invention are transverse to the direction of strip movement and are generally straight lines, although slightly curved lines may also be provided. Preferably, the scribe lines are substantially normal or perpendicular to the direction of strip movement as shown in FIG. 1. Alternatively, the scribe lines may be angularly transverse to the strip movement direction. Regulating the relative speeds of the strip movement, orientation angle of body 14, and speed of rotation of the carriage body 14 will provide the desired orientation of the scribe lines. By the present invention, the scribe lines are uniformly spaced apart at selected intervals on the strip surface.

In making or producing scribe line 24, the strip is initially contacted at or about one edge of the moving strip at a rearward area, designated by reference numeral 20, as a scribing device 16 on rotating body 14 approaches and makes scribing contact with moving strip S. Scribing device 16 moves transversely to the strip direction by the rotation of body 14. When contacting-type scribing means are used, the scribing device 16 slides across the moving strip. When scribing device 16 reaches the other edge, 22, of the strip at a forward area, scribing device 16 will break scribing contact with strip S by the rotation of body 14 and move about the axis of rotation of body 14 until it again makes contact with strip S at another rearward area 20. Due to the relative movement of strip S and rotation of carriage body 14, each scribing device, while in scribing contact with strip S, can be characterized as "chasing" the strip as it moves from rearward area 20 to forward area 22. Such scribing action is repeated by each of the plurality of scribing devices 16 to form the plurality of substantially parallel scribe lines at selected and uniform intervals.

In the operation of the apparatus, the strip, designated as S, moving in the direction of the arrows is roll-formed by rollers 10 to bring the surface thereof to be scribed in general conformity with the periphery of the carriage body 14 and scribing means 16 mounted thereon. Shaft 12 and body 14 are rotated by the variable-speed drive motor 34 through belt 36 and associated pulleys 38 and 40. As the body 14 rotates and the scribing devices 16 are passed in rotating movement adjacent the strip concave surface and in scribing contact with the strip surface, the desired scribing is produced. After scribing, the curved sheet would leave rollers 10 and return to its original flat shape for further processing and subsequent coiling.

By way of an example, for a commercial production operation, the silicon steel strip may be about 36 inches (91.4 cm) wide and may have a speed of about 300 FPM (feet per minute) (1.52 meters/second). The carriage body 14 may be a wheel of about 48 inc (121.9 cm) in diameter and if rotated at 119.37 revolutions per minute, the periphery or rim velocity of body 14 would be 1500 FPM (7.62 m/s). To scribe the strip with scribe lines substantially normal to the strip movement, an angle of about 11.3° would be provided with spacing between scribing devices 16 on the body periphery being about 1.25 inches (3.175 cm).

As is an object of the present invention, scribing can be performed at typical silicon steel strip line speeds with control of the scribing operation being possible relative to strip line speeds by control of the orientation of the carriage body and speed thereof. The angular orientation and spacing of the scribe lines can also be provided relative to such speeds. It should be further understood that the strip to be scribed may be moved substantially horizontally, vertically, or at various positions therebetween, for the embodiments shown in the Figures are not limited to any particular arrangement.

Although several embodiments of the present invention have been shown and described, it will be apparent to those skilled in the art that modifications may be made therein without departing from the scope of the present invention.

What is claimed is:

1. An apparatus for scribing grain-oriented silicon steel strip to improve the watt losses thereof, said apparatus comprising:

a carriage body, rotatable about an axis and having a diameter at least as great as the strip width;

means for rotating said body;

means for scribing mounted on said body at or about the periphery thereof and movable therewith;

means for forming the strip into an arcuate shape about an axis parallel to the direction of strip movement, said means including a plurality of separate adjustable nondriven rollers positioned on opposite sides of the strip and having minimal line contact therewith to provide a strip pass line substantially conforming to the arc defined by the periphery of said rotatable body and for bringing the concave surface of the moving arcuate-shaped strip into scribing contact with said scribing means;

means for regulating the relative speed of the strip movement and speed of rotation of the carriage body with said scribing means thereof; and means for adjustably orienting the carriage body such that the plane of rotation of the scribing means on the rotating body forms an angle of between 5 and 15 degrees from a plane perpendicular to the direction of strip movement in relation to the speed of strip movement;

said strip initially contacted by said scribing means at a rearward area of the moving strip such that said scribing means moves across the strip transversely to the direction of strip movement to form a scribe line which is at a selected spaced-apart distance from an adjacent scribe line.

2. The apparatus of claim 1 wherein said carriage body is disc shaped.

3. The apparatus of claim 1 wherein the means for rotating said body includes a shaft and variable speed motor.

4. The apparatus of claim 1 wherein said carriage body has a means for cooling said scribing means.

5. The apparatus of claim 1 wherein said means for scribing makes sliding contact as it transverses the moving strip.

* * * * *